United States Patent [19]

Magill et al.

[11] Patent Number: 4,592,535

[45] Date of Patent: Jun. 3, 1986

[54] DAMPER BLADE

[75] Inventors: Robert J. Magill, Whitstable; David J. Gaiger, Deal, both of England

[73] Assignee: Actionair Equipment Limited, Whitstable, England

[21] Appl. No.: 695,704

[22] Filed: Jan. 25, 1985

[30] Foreign Application Priority Data

Jan. 27, 1984 [GB] United Kingdom ..... 8402219

[51] Int. Cl.[4] ..... F16K 1/16

[52] U.S. Cl. ..... 251/298; 29/156.7 R; 98/121.2

[58] Field of Search ..... 251/298, 299, 356; 98/110, 114, 121.2; 29/156.7 R

[56] References Cited

U.S. PATENT DOCUMENTS

| | | | |
|---|---|---|---|
| 1,357,440 | 11/1920 | Britcher | 251/298 |
| 2,884,005 | 4/1959 | Honerkamp et al. | 98/121.2 |
| 3,270,657 | 9/1966 | Jaye | 98/110 |
| 3,451,165 | 6/1969 | O'Hair | 98/121.2 |
| 3,654,851 | 4/1972 | Bertin et al. | 98/110 |

*Primary Examiner*—A. Michael Chambers
*Assistant Examiner*—Sheri M. Novack
*Attorney, Agent, or Firm*—Berman, Aisenberg & Platt

[57] ABSTRACT

A fluid damper blade made by bending a sheet of metal into a U and bringing the edges of the U together to form the trailing edge of the blade, the two edges of the U being of castellated form so that they interlock when brought together, with the castellations being bent over so as to embrace a reinforcing locking rod extending the full length of the blade trailing edge. This gives the blade enhanced rigidity and increased resistance to bending and twisting stresses. In addition, welding of the edges of the U is made unnecessary.

2 Claims, 14 Drawing Figures

DAMPER BLADE

This invention relates to blades for use in fluid dampers. In particular, it relates to damper blades which are so mounted in a damper as to be rotatable about respective axes extending lengthwise of the blades in order that they move between a position in which the blades close a passage through the damper and a fully open position in which they allow the free passage of air or other gaseous fluid through that passage. Such dampers are widely used in air ventilation systems.

Nowadays it is quite usual for damper blades to be made by bending a sheet of metal—for example, stainless steel—into a U and bringing the edges of the U together to form the trailing edge of the blade. In some forms of blade the two edges of the U are directly spot-welded to each other. In other cases, one of the edges is bent over the other edge prior to the spot-welding operation. Another way of connecting the edges of the U together is by enclosing them in a V-section strip which is then spot-welded to those edges.

By way of illustration, these three prior methods of welding the edges of the U together are shown in FIGS. 1–3 respectively of the accompanying drawings. Thus FIG. 1 shows a blade wherein the edges are spot-welded at 10 directly to each other; FIG. 2 shows a blade wherein one of the edges is turned over the other at 12 prior to the spot-welding operation; and FIG. 3 shows a blade wherein the edges are enclosed in a V-section strip 14 which is then spot-welded at 10 as in FIGS. 1 and 2.

Welded blades of the construction shown in FIGS. 1–3 have proved satisfactory in use but they are not especially resistant to bending or twisting stresses. The aim of the present invention therefore is to provide a form of blade which has a reinforced trailing edge so as to provide improved resistance to those stresses. A secondary aim is to avoid the need for any welding of the metal used for the blades.

With these considerations in mind, a damper blade in accordance with the invention is made by bending a sheet of metal into a U and bringing the edges of the U together to form a trailing edge of the blade in a manner similar to that illustrated in FIGS. 1–3. However, in contrast to those constructions, the blade of the present invention has edges of castellated form so that they interlock together with the castellations being bent, turned or rolled over so as to embrace a reinforcing locking rod.

An example of a damper blade in accordance with the invention is shown in FIGS. 4–14 of the accompanying drawings, in which FIG. 4 is a plan view of a metal strip from which a blade is to be formed;

Figure 4:
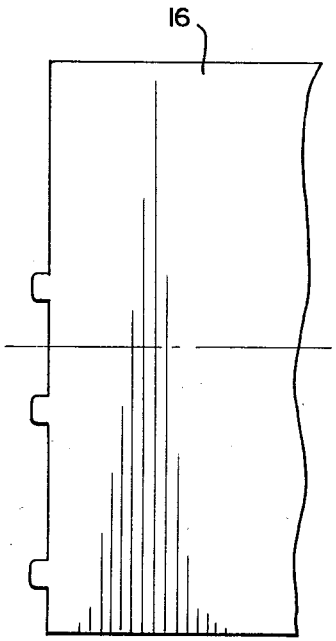

The metal strip 16 shown in FIG. 4 can be drawn off a large roll and can be of stainless steel, galvanised sheet steel, aluminium alloy, brass or bronze to name but a few metals which can be used in producing a blade in accordance with the invention. The reason why such a large choice of different metals is now available is because the construction of the blade is not dependent on a welding operation.

A blank 18 (see FIG. 5) is produced from the strip 16 in order to make each blade. As will be seen, the blank has projections 20 at its ends to permit it to be used in conjunction with retaining means (not shown) for retaining it on a blade support in a fluid damper. The two longer edges of the blank 18 are provided with castellations 22 and 24, the castellations 22 being so formed that the gaps between them are in alignment transversely of the blank with the castellations 24.

Figure 5:
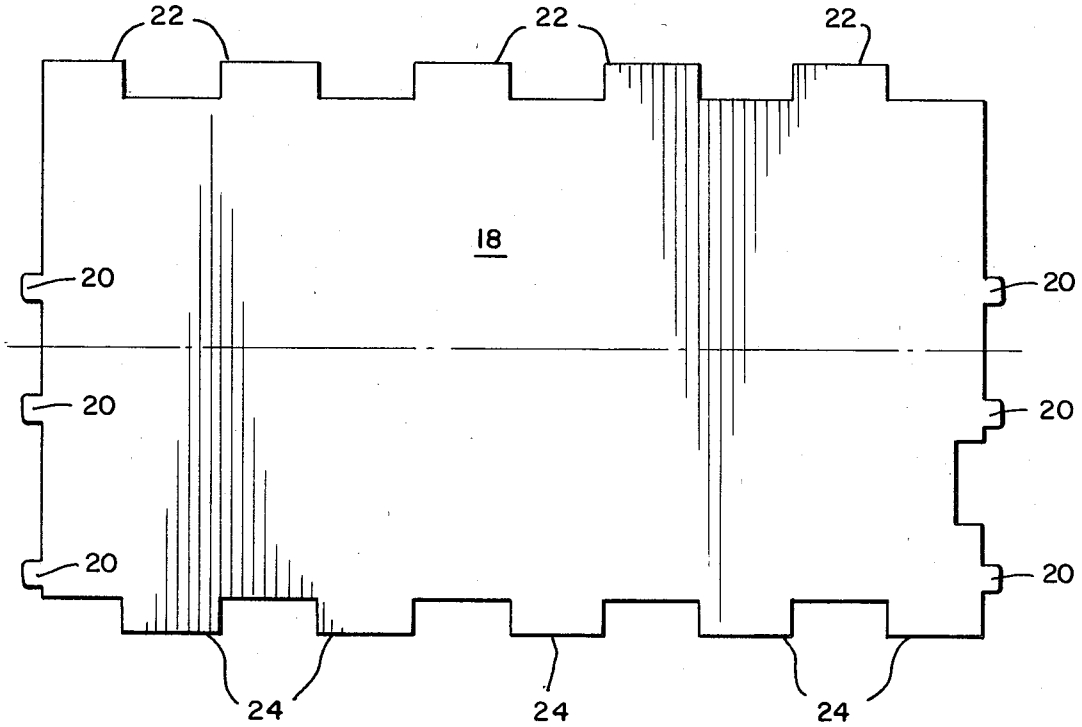
FIG. 5 is a plan view of a castellated blank stamped or otherwise formed from the strip shown in FIG. 4.
Figure 6:
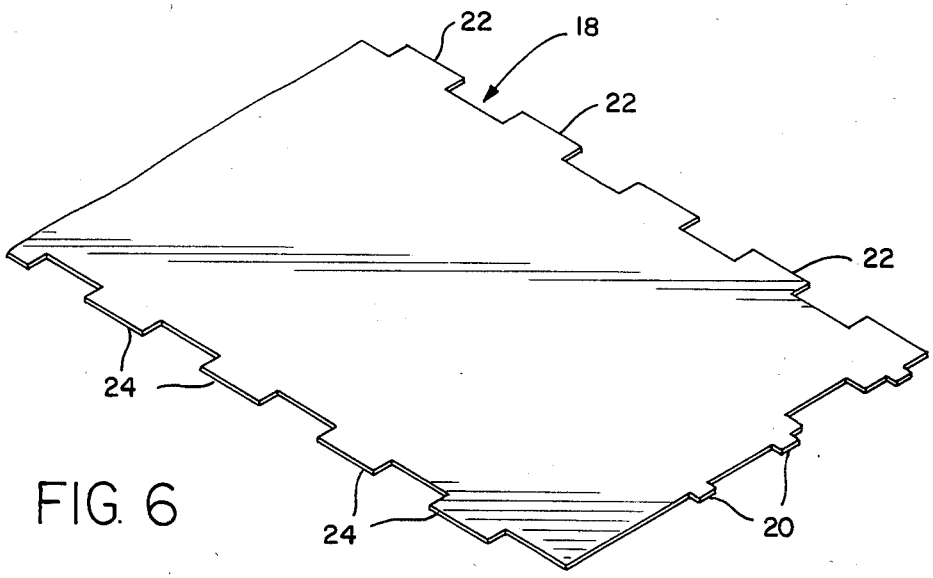
FIG. 6 is a perspective view of the castellated blank shown in FIG. 5.
Figure 7:
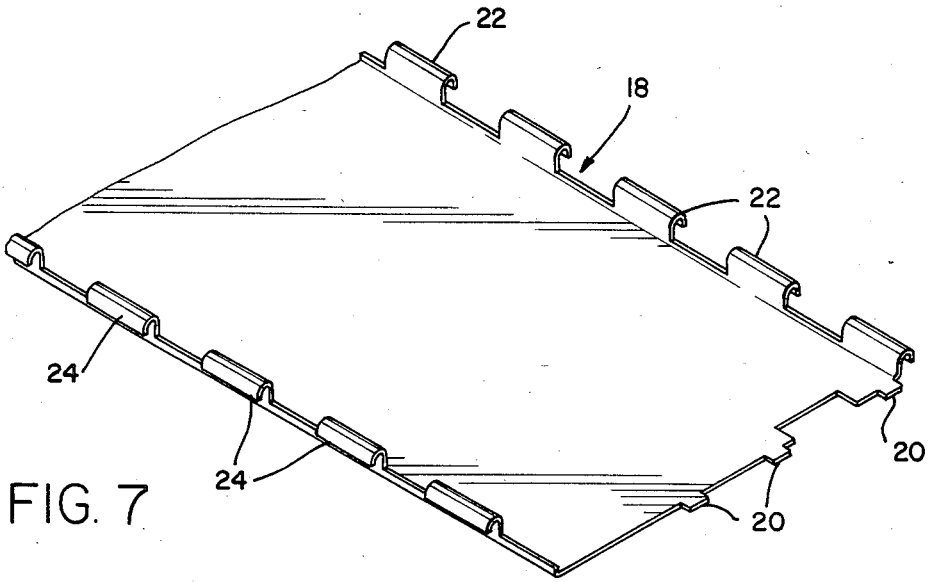
FIG. 7 is a view similar to FIG. 6 showing the castellations bent over into a hook formation.
Figure 8:
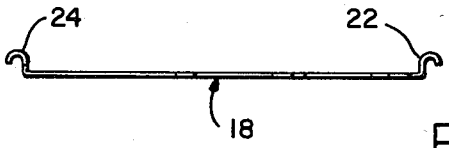
FIG. 8 is an end view of the blank shown in FIG. 7.
Figure 9:
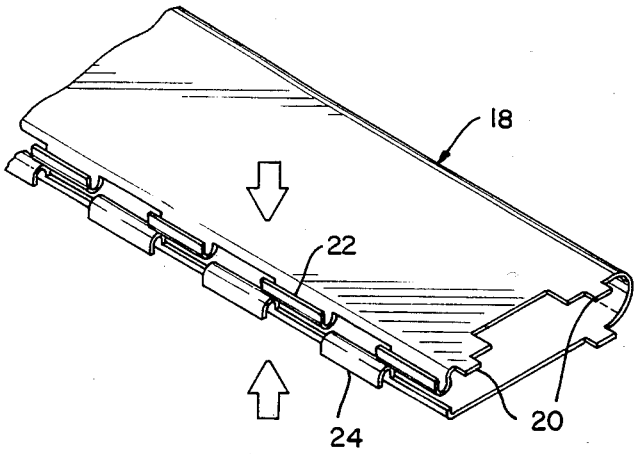
FIG. 9 is a perspective view of the blank after it has been bent into a U shape.
Figure 10:
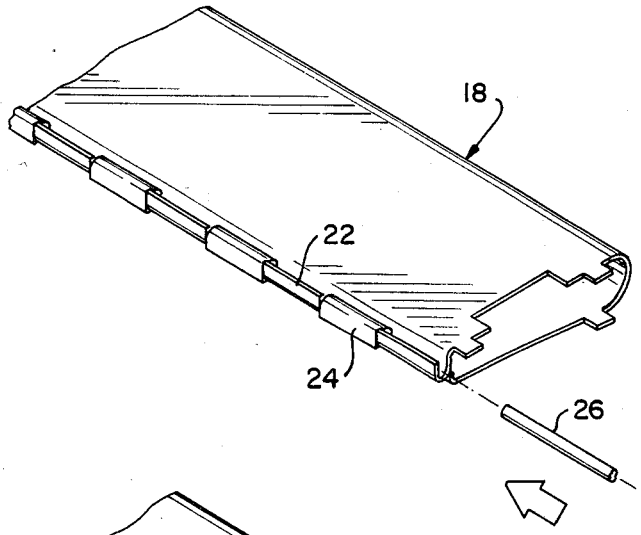
FIG. 10 is a perspective view with the castellated edges brought closer together so as to permit the insertion of a reinforcing locking rod.
Figure 11:
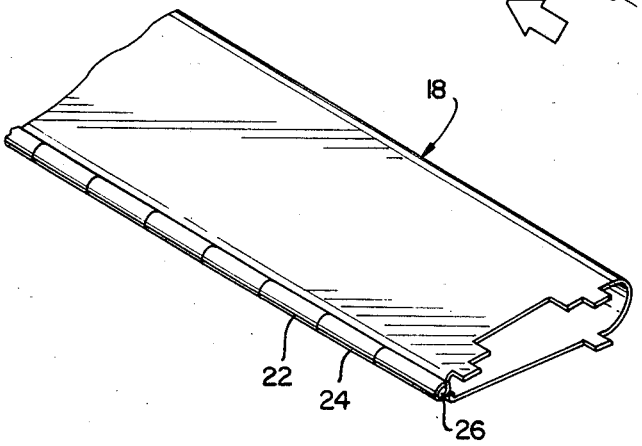
FIG. 11 is a perspective view of the blade with reinforcing locking rod inserted and with the castellations bent, turned or rolled over so as to embrace that rod.

The castellated blank shown in FIGS. 5 and 6 then has the castellations 22 and 24 turned over into a hook formation as shown in FIGS. 7 and 8. The blank is now ready to be bent into a U as shown in FIG. 9. A reinforcing locking rod 26 is then made ready for insertion into the grooves of the hook-like castellations once the latter have been interlocked with each other as shown in FIG. 10. Once the reinforcing rod 26 has been inserted into the hook-like castellations, the latter are bent, turned or rolled over as shown in FIG. 11 so as to embrace the rod very tightly. The rod is in fact hidden from sight (apart from its ends) once this operation has been completed.

Figure 12:
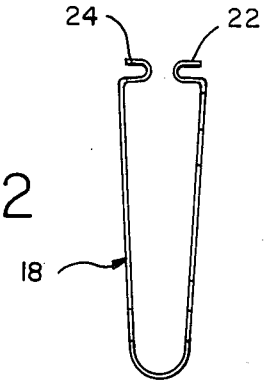
FIGS. 12–14 are end views of the blade corresponding to what is shown in FIGS. 9–11, respectively.
Figure 13:
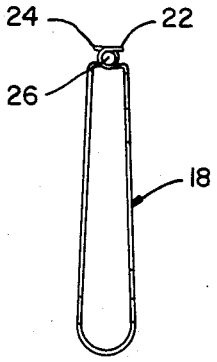
Figure 14:
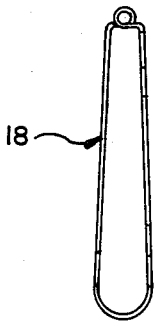

FIGS. 12–14 illustrate in end view the closing together of the castellated edges of the blank illustrated in FIGS. 9–11.

Figure 1:
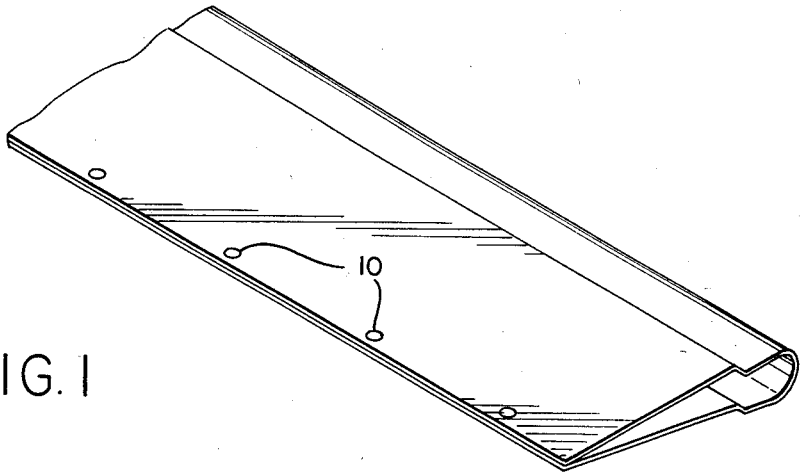
Figure 2:
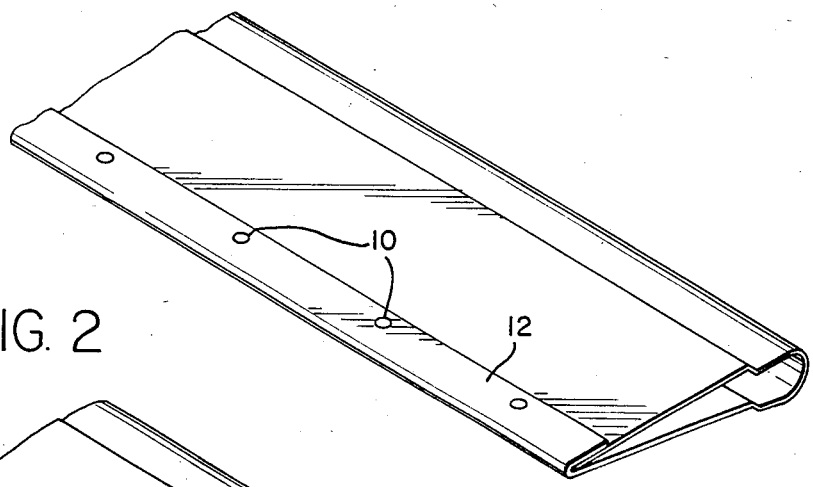
Figure 3:
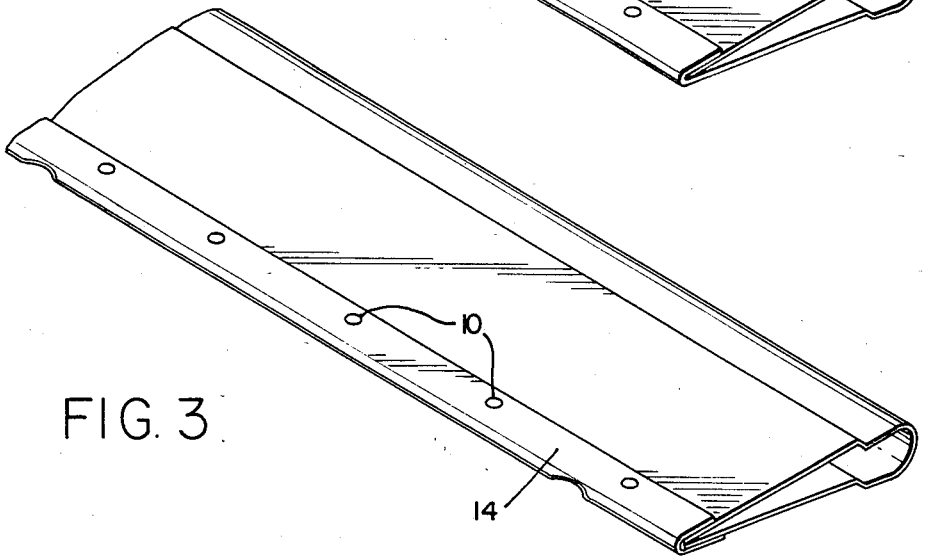

When the castellations are bent, turned or rolled over on to the rod, it has the effect of pulling the two edges so close together that any gap between the interlocking castellated edges is closed. This fact, together with the presence of the reinforcing locking rod, causes the blade to have considerably enhanced rigidity and resistance to bending and twisting stresses. In fact, the resistance to such stresses is increased by at least 50% when compared with the resistance to bending and twisting of the blades shown in FIGS. 1–3.

The invention finds particular application in dampers where the blades are required to rotate through an angle of 360°, but the invention is not restricted to that particular use of the blades.

We claim:

1. A rigid blade for use in a fluid damper, said blade being made by bending a one-piece sheet metal blank into an elongate U-section channel member and bringing the longitudinal edges of the channel together to form a trailing edge of the blade, wherein said longitudinal edges of the channel are of castellated form throughout their length with castellations on one longitudinal edge of said blank being so formed that the gaps between adjacent castellations are in alignment transversely of the blank with the castellations on the other longitudinal edge and are of the same length as the castellations on said other longitudinal edge whereby those edges interlock when brought together to prevent relative movement between the edges, said castellations being first bent into a hook formation whereby U-shaped grooves are formed in the castellations to receive a reinforcing locking rod extending the full length of said blade trailing edge, said hooked castellations thereafter being rolled over to embrace the rod very tightly in order to increase the resistance of the blade to bending and twisting stresses and to avoid the necessity for any welding at the blade trailing edge, the rod thereby being hidden from sight apart from its ends.

2. A damper blade according to claim 1, wherein said blade is formed from a blank of a metal selected from the following group of metals: stainless steel, galvanised steel, aluminium alloy, brass and bronze.

* * * * *